United States Patent [19]

Masuda et al.

[11] 4,169,695

[45] Oct. 2, 1979

[54] ELECTROMAGNETIC PUMP WITH PRESSURE-REGULATING MECHANISM

[75] Inventors: Naosuke Masuda; Sumio Yamaguchi, both of Higashimatsuyama, Japan

[73] Assignee: Jidosha Kiki Co., Ltd., Tokyo, Japan

[21] Appl. No.: 823,599

[22] Filed: Aug. 11, 1977

[30] Foreign Application Priority Data

Aug. 20, 1976 [JP] Japan ..... 51/98758
Aug. 20, 1976 [JP] Japan ..... 51/110704

[51] Int. Cl.[2] ..... F04B 49/00
[52] U.S. Cl. ..... 417/311; 417/417
[58] Field of Search ..... 417/311, 308, 307, 417, 417/441

[56] References Cited

U.S. PATENT DOCUMENTS

| | | | |
|---|---|---|---|
| 2,311,655 | 2/1943 | Freeman et al. | 417/307 |
| 2,931,314 | 4/1960 | Erikson et al. | 417/307 |
| 3,446,231 | 5/1969 | Magnuson | 417/308 |
| 3,545,887 | 12/1970 | Kobnick | 417/307 |
| 4,021,152 | 5/1977 | Toyoda | 417/311 |

*Primary Examiner*—Carlton R. Croyle
*Assistant Examiner*—Thomas I. Ross
*Attorney, Agent, or Firm*—Charles E. Pfund

[57] ABSTRACT

An electromagnetic pump is disclosed in which a pair of check valves and a pressure-regulating mechanism are inserted in series in a fluid passage extending from a suction inlet to a discharge outlet and a pressure chamber operatively connected with a plunger is provided between the check valves. When a solenoid coil surrounding the plunger is supplied with an intermittent electric current, the plunger moves to and fro, thereby the pressure in the pressure chamber being varied to have the check valves given rise to pumping action. The pressure-regulating mechanism function to control the pressure of fluid discharged from the outlet, thereby absorbing the pulsation generated by the reciprocal pumping action of the plunger.

5 Claims, 9 Drawing Figures

ELECTROMAGNETIC PUMP WITH PRESSURE-REGULATING MECHANISM

BACKGROUND OF THE INVENTION

This invention relates to an electromagnetic pump, and more particularly, to an electromagnetic pump for fluid transfer in which an electric current is intermittently supplied to a solenoid coil to cause a plunger to be moved to and fro, thereby causing a pair of check valves arranged in a fluid passage to open and close alternately so as to give rise to a pumping action.

The pumping action produced by the use of a pair of check valves produces a pulsating flow at the discharge side of the pump.

Because of this pulsating flow, it is impossible to maintain a constant output pressure. To solve this problem, pressure-regulating mechanism has been employed in parallel with a fuel pasage which is adapted to detect the fluid pressure at the discharge side and to feed back a part of the fluid to the inlet when the pressure detected exceeds a predetermined value. Such pressure-regulating mechanism is disclosed in my Japanese Pat. No. 50-33302.

The pressure-regulating mechanism employed in the aforesaid patent, however, does not suffice to entirely absorb the pulsation at the discharge because the pressure-regulating mechanism only detects the pressure variations at the discharge side of the pump at a position in parallel with the discharge passage.

Furthermore, in conventional electromagnetic pumps of this kind, the check valves are not sufficiently tight to prevent fuel leakage and, hence, escape of fuel through the outlet when the pump is at rest, particularly when the pump is turned upside down and/or there is a pressure head at the inlet port. Such leakage is particularly hazardous.

To solve these problems, in the prior art, an additional electromagnetic valve has been provided in the fuel passage between the outlet of the electromagnetic pump and the nozzle of a burner for spraying fuel discharged from the pump. this additional electromagnetic valve is opened when the pump is in operation, and it is closed when the pump is at rest, thereby preventing the fuel from leaking. With this method, however, it is required to provide an additional electromagnetic valve which in turn requires an additional space for mounting. The cost of the assembly is thus undesirably increased. Still further, to avoid the above shortcomings, another improvement has been proposed, to wit, to use a solenoid coil of the electromagnetic pump to energize the electromagnetic valve. This reduces the space requirements and cost considerably, but makes installation more complicated and requires a resdesign of the pump which, in turn, makes it more difficult to control leakage.

SUMMARY OF THE INVENTION

Therefore, an object of the present invention is to provide an electromagnetic pump having a pressure-regulating mechanism capable of absorbing pulsation due to pumping action and ensuring to transfer fluid in a stable manner.

Another object of the present invention is to provide an electromagnetic pump having a pressure-regulating mechanism adapted to prevent fluid leakage by means of a simple fluid leak-prevention means when the pump is at rest.

As herein illustrated, the electromagnetic pump comprises a pump body containing a pump chamber which has at one end a suction inlet port, a discharge port and a fluid passage connecting the other end of the pump chamber to the discharge port, a pair of reversely-positioned check valves mounted in the pump chanber with a space therebetween, a pressure chamber in communication with the space between the check valves, a ram supported with an end in the pressure chamber, said ram being reciprocable to alternately open one check valve and close the other and electromagnetic means for effecting reciprocation of the ram to alternately suck fluid in through the inlet port and discharge it through the discharge port characterized in that the valve body also contains a pressure-regulating chamber, and pressure-regulating mechanism in the pressure-regulating chamber, said pressure-regulating chamber being arranged in alignment with the discharge port and in series therewith so that the latter is concentric with one end of the pressure regulator chamber and is connected at that end to the pump chamber by way of said fluid passage, said regulating mechanism comprising a plunger in the pressure-regulating chamber which defines in conjunction with the pressure-regulating chamber a discharge chamber at one end of the plunger which is in communication with said flow passage and a relief chamber at the other end of the plunger, spring biasing means within the pressure regulator chamber yieldably holding the plunger in a position to block the discharge port, said plunger being yieldable to the pressure of the fluid generated by the pumping action of the ram entering the discharge chamber through the fluid passage to displace the plunger relative to the discharge port to thus permit the fluid to be discharged through the discharge port, said plunger containing an axial opening, a normally-seated spring-biased relief valve supported on the plunger in a position blocking said opening for movement with the plunger and movement relative thereto, said relief valve when open permitting flow of fluid from the discharge chamber to the relief chamber, an adjustable pressure regulator mounted in the relief chamber in axial alignment with the plunger and the relief valve in a position to displace the relief valve when the plunger is displaced a predetermined distance by the pressure of the fluid in the discharge chamber and a fluid flow passage connecting the relief chamber to the pump chamber at the inlet side of the check valves.

According to another embodiment of the invention, in the electromagnetic pump described above, there is further provided an elastic sealing member which is located between the pressure-regulating plunger and the discharge port. When the solenoid coil of the electromagnetic pump is deenergized, a spring moves the pressure-regulating plunger in a direction to press the elastic sealing members against the discharge port.

BRIEF DESCRIPTION OF THE DRAWINGS

Other objects and features of the invention will be more fully understod from the following description taken in connection with the accompanying drawings, in which.

DETAILED DESCRIPTION OF THE PREFERRED EMBODIMENTS

Figure 1:
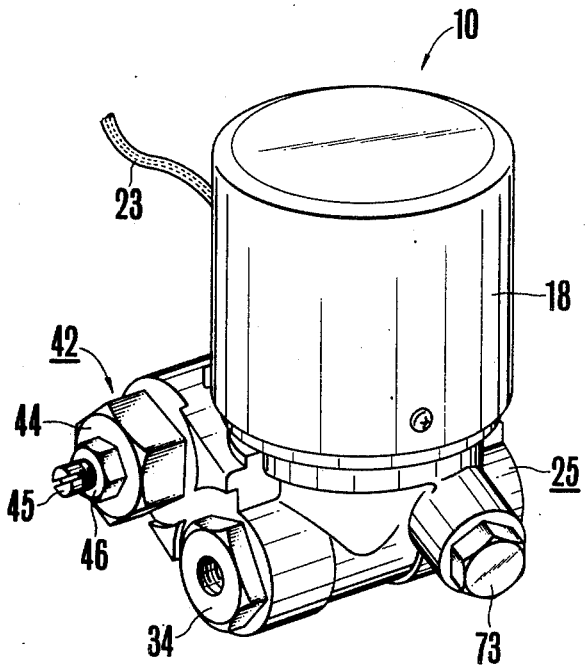
FIG. 1 is a perspective view showing one embodiment of an electromagnetic pump with a pressure-regulating mechanism according to the invention.

FIGS. 1-5 diagramatically illustrate a first preferred embodiment of an electromagnetic pump 10 according to the invention. The electomagnetic pump 10 is provided with a pole piece 11 which is made of magnetic material in the form of a cup, of which the bottom is kept upwardly, a hollow cylindrical spacer 12 which is made of non-magnetic material, and a hollow cylindrical pole piece 13 which is made of magnetic material. The pole piece 11, spacer 12 and pole piece 13 are disposed along an identical axial line in the order of the above description. The pole piece 13 is secured to a yoke 14. A cylindrical inner space defined with said pole piece 11, spacer 12 and pole piece 13 is made to receive slidably a plunger 15. This plunger 15 is normally biased upwardly by a return spring 16. The upper end of plunger 15 abuts a stopper 17, of which one face contacts with the top portion of the pole piece 11 forming said inner space. This stopper 17 also has an ability to absorb the shock occurring at the end of upward travel of the plunger 15. This plunger 15 comprises the plunger body **15*a* which is always contained in said inner space and the plunger rod 15*b* which projects downwardly through an opening of the pole piece 13 secured to the yoke 14. The plunger body 15*a*** has a diameter which is determined so as to allow plunger travel in said inner space.

Figure 2:
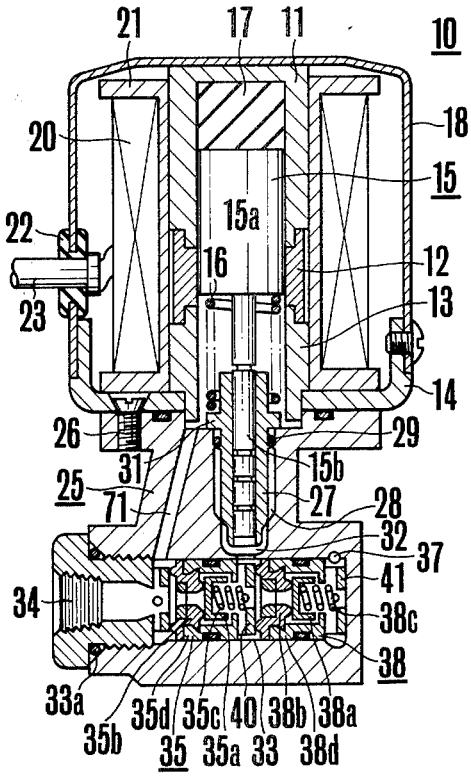
FIG. 2 is a vertical cross sectional view of the pump of FIG. 1.

The opening end of a cup shaped housing 18 is secured to said yoke 14 with a fastening means such as screws so as to cover entire parts including pole piece 11 and 13. These pole piece 11 and 13 and the spacer 12 are contained in the hollow portion of a bobbin 21 on which a solenoide coil 20 is winded. The solenoid coil 20 is supplied with an intermittent electric current through a power cable 23 led to the housing 18 via bushing 22 provided thereon, thereby the plunger 15 is reciprocated in cooperation with a return spring 16. A pump body 25 is installed on said yoke 14 with screws 26. The pump body 25 has a threaded hole 28 for receiving a sleeve 27 which accepts slidably the pressure plunger portion **15*b* extending downwardly from the plunger 15. Said sleeve 27 is inserted into said hole 28 by using O-ring 29. The sleeve 27 has a flange 31 which is used for determining the axial position of the sleeve in the threaded hole 28. The lower end of said return spring 16 is stopped at the flange set forth above. As shown in FIG. 2, the plunger 15 is adjusted so as to result in a predetermined pump characteristic by setting a distance l between the lower end of the plunger body 15*a* and the upper end of the pole piece 13 when the plunger 15** moves to the upper limit.

The lower portion of the threaded hole 28 containing the sleeve 27 is constricted so as to provide a pressure chamber 32 and this is connected with a hole 33 the axis of which is at right angle to the pressure plunger **15*b*. The hole 33 communicates with an opening 33*a* which is provided on one face of the pump body 25 so as to have said threaded hole 28 positioned at almost center of the hole 33. The opening 33*a* receives a suction plug 34 screwed therein through an O-ring. Between the suction plug 34 and the threaded hole 28 in the hole 33, there is provided a suction check valve 35, which is well known and comprises a valve 35*a*, a valve seat 35*b*, a spring 35*c* and a frame 35*d*. This suction check valve 35 is operated as follows. When a fuel is sucked through the suction plug 34, the valve 35*a* is lifted up from the valve sheet 35*b* opposing against the spring force of the spring 35*c* to open the valve. In the contrary case to the above, the spring force of the spring 35*c* pushes the valve 35*a* against the valve seat 35*b* to close the valve. A discharge check valve 38 is mounted within the hole 33 at a position between the outlet port 37 and the opening of threaded hole 28. The outlet check valve 38 has the same construction as the inlet check valve 35 and is aligned therewith in the same direction. Each part of the outlet valve 38 corresponding to that of the inlet valve 35 is designated by the corresponding letter. Between the check valves 35 and 38 is located a passage member 40 having a cross passage so that the check valves 35 and 38 each may effectively be actuated in response to pressure variation in the pressure chamber 32, because the horizontal passage interconnects the inlet and outlet valves 35 and 38 and the vertical passage communicates with the pressure chamber 32. A similar cross passage member 41 is also located in the hole 33 on one side of the outlet check valve 38 next to the outlet port 37. These passage members 40 and 41 may be a part integral with the check valves 35 and 38**, respectively.

Figure 3:
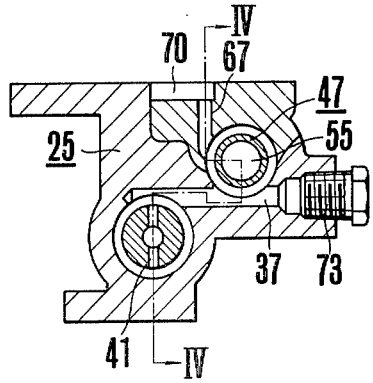
FIG. 3 is a cross-sectional view of a pump body taken on line III—III of FIG. 4.
Figure 4:
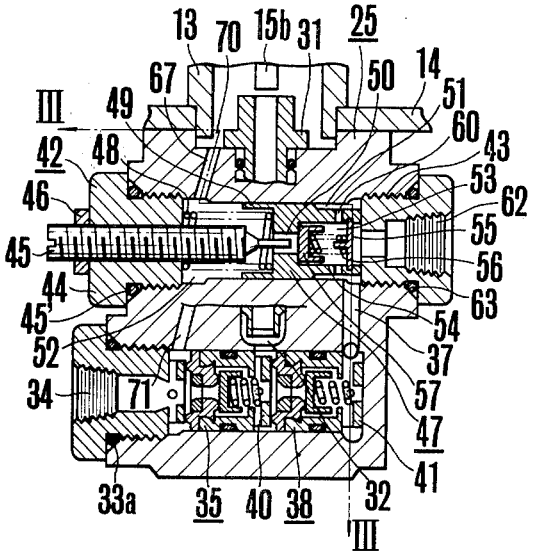
FIG. 4 is a cross-sectional view of the pump body taken on line IV—IV of FIG. 3.
Figure 5:
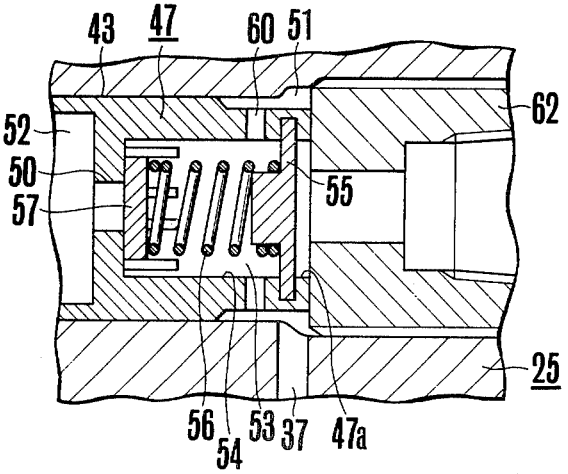
FIG. 5 is an enlarged view of the pressure-regulating mechanism and the discharge plug shown in FIG. 4.

The structure of a portion of the pump body following the outlet port 37 is illustrated in FIGS. 3 and 4. FIG. 3 is a cross sectional view taken on line III—III in FIG. 4 and FIG. 4 on line IV—IV in FIG. 3. an enlarged view of a part of FIG. 4 is shown in FIG. 5. In FIG. 4, the pump body 25 is provided with a through bore 43 for accommodating a pressure-regulating mechanism 42. The through hole 43 is placed so that it does not traverse the threaded hole 28 and is extended from one side to the other side of the body 25 substantially in parallel with the above-mentioned hole 33. The through hole 43 communicates with the outlet port 37 at the right side in FIG. 4 (In this respect, the outlet port 37 is an interconnecting or intermediary port.) A plug 44 is threaded in the through hole 43 at the left side with a sealing member 45' inserted therebetween. A pressure-regulating rod 45 is axially threaded into the plug 44 at its center and fixed threat by a nut 46. The free end of rod 45 projects in the through hole 43. The effective length of the pressure-regulating rod 45 can be adjusted by turning it by means of a suitable tool. In the through hole 43 is installed a pressure-regulating plunger 47 in a slidable manner. The plunger 47 is normally biased rightwardly (in the drawing) by a spring 48 which surrounds the rod 45 and is supported by the plug 44. This pressure regulating plunger 47 has a hollow cylindrical side wall 49 extending toward the plug 44 for enclosing and receiving the spring 48 and a port 50 at its center portion wall through which the free end of pressure-regulating rod 45 is freely moved. The port 50 also serves as a leakage path for communicating a pressure chamber 51 with a pressure release chamber 52 defined in the through hole 43 on opposite sides of the pressure regulating plunger 47 as described later. The pressure-regulating plunger 47 is provided with a recess 54 to define an interior pressure chamber 53 on the side remote from the cylindrical side wall 49 (see FIG. 5). the communicating port 50 is open at the bottom of recess 54. A fixing member 55 is fixedly secured to a free opening edge 47*a* of the recess 54. A spring 56 supported by the fixing member 55 at one end pushes a valve 57 onto the bottom face of recess 54 to close the port 50. The side wall of the recess 54 defining the interior pressure chamber 53 is provided with ports 60 in radial direction of the plunger 47.

An outlet plug 62 is axially threaded in the through hole 43 with a sealing member 63 inserted therebetween. By the action of spring 48, the plunger 47 is biased to the right so that the edge 47*a* of the plunger 47 abuts the end face of the outlet plug 62 to close the opening of the outlet plug 62 because the opening of the edge 47*a* is blocked by the fixing member 55 (FIG. 5). A compartment defined within the through hole 43 by the pressure-regulating plunger 47 and the outlet plug 62 constitutes the pressure chamber 51 including the interior chamber 53, while a compartment defined within the same bore 43 by the pressure-regulating plunger 47 and the plug 44 constitutes the pressure release chamber 52. The pressure chamber 51 communicates with the outlet port 37 as previously described and the pressure release chamber 52 communicates with a plunger chamber 70 by way of a passage 67. The plunger chamber 70 is a space defined within the bore of pole piece 13 by the plunger body 15*a* and plunger rod 15*b* of the plunger 15 and the flange 31. The plunger chamber 70 also communicates with the bore 33 at a position between the inlet plug 34 and the inlet check valve 35 by way of a passage 71 (FIG. 2). In FIGS. 1 and 3, numeral 73 is a blind plug.

With the above arrangement, intermittent electric current is supplied to the solenoid coil 20 which cooperates with the return spring 16 to move the plunger 15 in a reciprocating manner. The plunger rod 15*b* is thus moved in a reciprocating manner so that the pressure chamber 32 the volume of which depends on the travel of plunger rod 15*b* is subjected to compression and expansion alternately, resulting in pressure variation. As a result, for example, assuming that the pressure chamber 32 is at expansion, a negative pressure is generated and transmitted to the passage of cross member 40. This negative pressure keeps the outlet check valve 38 closed, but permits the valve body 35*a* to move apart from the seat 35*b* against the action of spring 35*c* to open the inlet valve 35, thereby sucking fuel through the suction port of inlet plug 34. On the other hand, assuming that the pressure chamber 32 is at compression, a positive pressure is generated and transmitted to the passage of cross member 40. This positive pressure keeps the inlet check valve 35 closed, but causes the valve body 38*a* to move apart from the seat 38*b* against the action of spring 38*c* to open the outlet valve 38, thereby transferring the fuel in the passage of cross member 40 toward the outlet port 37. That is, compression and expansion of the pressure chamber 32 enables the check valves 35 and 38 to perform pumping action so that fuel is sucked through the suction port of plug 34 and then fed to the pressure-regulating mechanism 42 by way of the interconnecting port 37.

In the pressure-regulating mechanism 42, fuel fed through the interconnecting port 37 proceeds to the pressure chamber 51 to increase the pressure therein, thereby moving the pressure-regulating plunger 47 leftward, i.e., toward the sealing plug 44 against the action of spring 48 (see FIGS. 4 and 5). Sealing between the edge 47*a* of the plunger 47 and the end face of outlet plug 62 is cancelled. The fuel which has been introduced in the pressure chamber 51 is discharged to the exterior of the pump through the port of outlet plug 62. As the fuel pressure in the pressure chamber 51 increases, the pressure-regulating plunger 47 is further moved leftward, and eventually the valve plate 57 which is forced onto the partition wall of plunger 47 by the spring 56 to block the port 50 and thus moved leftward integrally with the plunger 47 is brought into contact with the tip of pressure-regulating rod 45. A further leftward movement of the plunger 47 causes the valve plate 57 to move apart from the partition wall to open the port 50, through which part of fuel is diverged into the pressure-release chamber 52. The diversion in the pressure-release chamber 52 is then guided to the plunger chamber 70 through the port 67. Subjected to the pumping action of reciprocating plunger 15, fuel in the plunger chamber 70 is returned to a position between the inlet plug 34 and the inlet valve 35 through the port 71 (see FIG. 2). As the fuel pressure in the pressure chamber 51 of the pressure-regulating mechanism 42 decreases, the pressure-regulating plunger 47 is moved back rightward by the action of spring 48 to disconnect the engagement of the tip of rod 45 with the valve plate 57 so that the port 50 is again blocked by the valve plate 57.

The afore-mentioned pressure-regulation is repeated whenever the fuel pressure in the pressure chamber 51 exceeds a predetermined level. As a result, the pressure of fuel discharged from the port of outlet plug 62 is maintained constant and pulsating flow due to the pumping action of check valves is smoothed.

Since the pressure chamber 51 of the pressure-regulating mechanism 42 is inserted in series with the fuel passage extending from the inlet plug 34 to the outlet plug 62 and thus constitutes a part of the fuel passage, the pressure-regulating mechanism 42 can accurately follow any pressure change in the fuel passage so as to absorb pulsation substantially entirely.

Figure 6:
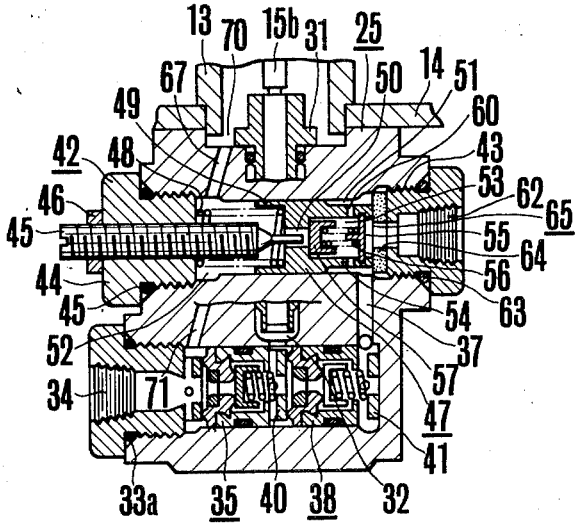
FIG. 6 is a cross-sectional view similar to FIG. 4, showing another embodiment of an electromagnetic pump with a modified pressure-regulating mechanism.
Figure 7:
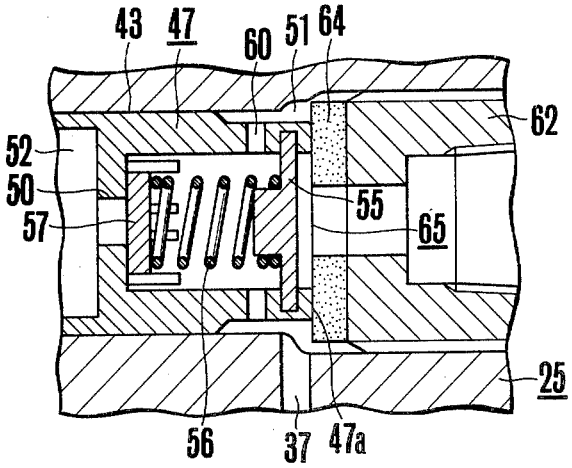
FIG. 7 is an enlarged view similar to FIG. 5, showing the leaktight valve built in the pressure-regulating mechanism of FIG. 6.

FIGS. 6 and 7 show another preferred embodiment of the electromagnetic pump according to the invention which is the same as the above embodiment in principle except for the sealing between the plunger 47 and the plug 62. In this embodiment, a leak-prevention valve 65 is inserted between the plunger 47 of the pressure-regulating mechanism 42 and the outlet plug 62 by placing therebetween a sealing member 64 consisting of a ring of elastic material such as rubber. The leak-prevention valve 65 is arranged so that it is closed by the action of biasing spring 48 associated with plunger 47 when the pumping action is interrupted. Fluid leakage is prevented in this way.

With this arrangement, when the electromagnetic pump 10 is at rest, that is, when the solenoid coil 20 is deenergized, the plunger 47 is biased rightward by the action of spring 48 in the pressure-regulating mechanism 42. Accordingly, the plunger 47 is tightly forced with its edge 47*a* to the elastic ring 64 adjacent to the outlet plug 62, and the elastic ring 64 is also tightly forced onto the facing edge of the outlet plug 62. This means that the leak-prevention valve 65 is firmly closed and the fuel passage from the interconnecting port 37 to the port of outlet plug 62 is blocked. The valve 65 can effectively prevent fuel leakage which is otherwise likely to occur when the pumping action is interrupted. Since it is only necessary to add the elastic ring 64 to the pressure-regulating mechanism of the electromagnetic pump shown in FIGS. 1–5, the leak-prevention valve 65 is very simple in structure and can be assembled without significant modification of the pump. The pumping action resulting from intermittent current supplied to the solenoid coil 20 is, of course, the same as described in the above embodiment. The leak-prevention valve according to the invention may be modified in structure.

Figure 8:
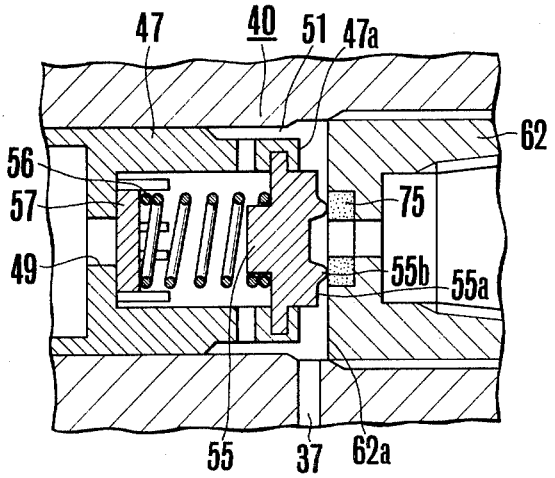
FIGS. 8 and 9 are enlarged views similar to FIG. 7, showing different examples of the leaktight valve, respectively.

FIG. 8 shows another arrangement of the leak-prevention valve. In the edge portion 47*a* of the pressure-regulating plunger 47 on the side of outlet plug 62 is staked a fixing member the center portion of which is projected beyond the extremity of edge portion 47*a* to form a flat projection 55*a* which is provided with a ringlike ridge 55*b*. In the opposite end face 62*a* of the outlet plug 62 is embedded a sealing ring 75 of elastic material.

With this arrangement, the leak-prevention valve operates as follows. When the plunger 47 is forced rightward by the action of spring 48, the ridge 55*b* is first brought into contact with the sealing ring 75. The pressing force exerted by the ridge 55*b* causes elastic deformation of the sealing ring 75 to ensure the fluid-tight engagement therebetween. The flat projection 55*a* is then brought into contact with the sealing ring 75 to ensure sufficient fluid-tightness. Upon contact with the sealing ring, the flat projection 55*a* also abuts the rigid end face 62*a* of the outlet plug 62 so that excessive pressing force is intercepted and excessive deformation of the elastic material is prevented. As a result, the arrangement of this embodiment improves not only fluid-tight engagement of the ridge 55*b* with the sealing ring 75, but also the durability of elastic material forming the sealing ring 75.

Figure 9:
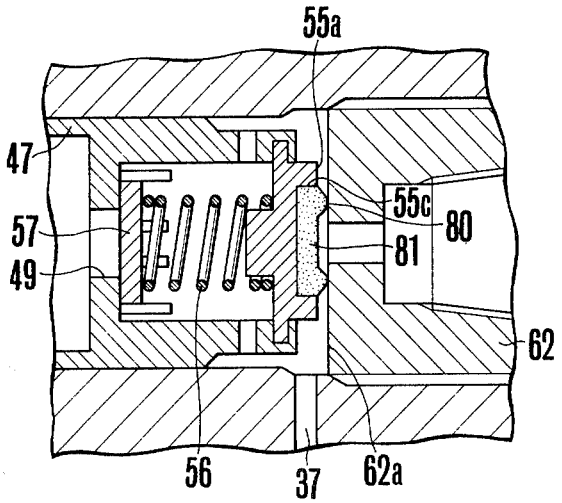

Still another example of the leak-prevention valve is illustrated in FIG. 9. As described with reference to FIG. 8, in the edge portion 47*a* of the pressure-regulating plunger 47 on the side of outlet plug 62 is staked a fixing member the center portion of which is projected beyond the extremity of edge portion 47*a* to form a flat projection 55*a*. In this example, however, the flat projection 55*a* is provided with a recess 55*c* in which a sealing member 81 of elastic material having a ring-like ridge 80 is fitted.

Similarly as in the case of FIG. 8, by bringing the ridge 80 into contact with the flat end face 62*a* of the outlet plug 62, the sealing member 81 is subjected to elastic deformation to achieve fluid-tight engagement. The flat projection 55*a* is then brought into contact with the face 62*a* to ensure firm fluid-tight engagement.

While the above embodiments are illustrated with reference to the fuel supply application, the electromagnetic pump of the invention can be applied to any kind of fluid.

Other modifications and variations of the invention are possible in the light of the above teachings. It is, therefore, to be understood that changes may be made in the particular embodiment of the invention described which are within the full intended scope of the invention as defined by the appended claims.

What is claimed is:

1. An electromagnetic pump comprising a pump body containing a pump chamber which has at one end a suction inlet port, a discharge port and a fluid passage connecting the other end of the pump chamber to the discharge port, a pair of reversely-positioned check valves mounted in the pump chamber with a space therebetween, a pressure chamber in communication with the space between the check valves, a ram supported with an end in the pressure chamber, said ram being reciprocable to alternately open one check valve and close the other and electromagnetic means for effecting reciprocation of the ram to alternately suck fluid in through the inlet port and discharge it through the discharge port characterized in that the valve body also contains a pressure-regulating chamber, and pressure-regulating mechanism in the pressure-regulating chamber, said pressure-regulating chamber being arranged in alignment with the discharge port and in series therewith so that the latter is concentric with one end of the pressure regulator chamber and is connected at that end to the pump chamber by way of said fluid passage, said regulating mechanism comprising a plunger in the pressure-regulating chamber which defines in conjunction with the pressure-regulating chamber a discharge chamber at one end of the plunger which is in communication with said flow passage and a relief chamber at the other end of the plunger, spring biasing means within the pressure regulator chamber yieldably holding the plunger in a position to block the discharge port, said plunger being yieldable to the pressure of the fluid, generated by the pumping action of the ram, entering the discharge chamber through the fluid passage to displace the plunger relative to the discharge port to thus permit the fluid to be discharged through the discharge port, said plunger containing an axial opening, a normally-seated spring-biased relief valve supported on the plunger in a position blocking said opening for movement with the plunger and movement relative thereto, said relief valve when open permitting flow of fluid from the discharge chamber to the relief chamber, an adjustable pressure regulator mounted in the relief chamber in axial alignment with the plunger and the relief valve in a position to displace the relief valve from said opening when the plunger is displaced a predetermined distance by the pressure of the fluid in the discharge chamber and a fluid flow passage connecting the relief chamber to the pump chamber at the inlet side of the check valves.

2. An electromagnetic pump according to claim 1 wherein an elastic sealing member is located between the end of the plunger and the discharge port, said elastic sealing member constituting with the plunger a leaktight valve which is held pressed in blocking position by the action of the spring-biasing means.

3. An electromagnetic pump according to claim 2 wherein the leaktight valve comprises a flat projection formed at the end of the plunger, a ring-like rib protruding from said flat projection toward the discharge port and a ring-like elastic sealing member provided peripherally of said discharge port.

4. An electromagnetic pump according to claim 2 wherein the leaktight valve comprises a flat projection formed at the end of the plunger, an elastic sealing member embedded in a recess formed at the center of the flat projection and a ring-like ridge and an end face surrounding the discharge opening.

5. An electromagnetic pump comprising a pump body containing a pump chamber which has at one end a suction inlet port, a discharge port and a fluid passage connecting the other end of the pump chamber to the discharge port, a pair of reversely-positioned check valves mounted in the pump chamber with a space therebetween, a pressure chamber in comunication with the space between the check valves, a ram supported with an end in the pressure chamber, said ram being reciprocable to alternately open one check valve and close the other and electromagnetic means for effecting reciprocation of the ram to alternately suck fluid in through the inlet port and discharge it through the discharge port characterized in that the valve body also contains a pressure-regulating chamber, and pressure-regulating mechanism in the pressure-regulating chamber, said pressure-regulating chamber being arranged in alignment with the discharge port and in series therewith so that the latter is concentric with one end of the pressure regulator chamber and is connected at that end to the pump chamber by way of said fluid passage, said regulating mechanism comprising a plunger in the pressure-regulating chamber which defines in conjunction with the pressure-regulating chamber a discharge chamber at one end of the plunger which is in communication with said flow passage, and a relief chamber at the other end of the plunger, spring biasing means within the pressure regulator chamber yieldably holding the plunger in a position to block the discharge port, said plunger being yieldable to the pressure of the fluid, generated by the pumping action of the ram, entering the discharge chamber through the fluid passage to displace the plunger relative to the discharge port to thus permit the fluid to be discharged through the discharge port, said plunger having an imperforate end portion for blocking the discharge port when engaged therewith, an axial passage extending from the imperforate end to the opposite end in communication with the relief chamber, a port adjacent its imperforate end in communication with the discharge chamber, a spring biased relief valve in the passage intermediate its ends in a position normally blocking flow of fluid through the passage into the relief chamber, an adjustable pressure regulator mounted in the relief chamber in axial alignment with the plunger and the relief valve in a position to displace the relief valve from its blocking position when the plunger is displaced a predetermined distance and a fluid flow passage connecting the relief chamber to the pump chamber at the inlet side of the check valves.

* * * * *